US007287344B2

(12) United States Patent
Kostyak

(10) Patent No.: US 7,287,344 B2
(45) Date of Patent: Oct. 30, 2007

(54) LANDSCAPING APPARATUS AND METHOD

(76) Inventor: Bradley W. Kostyak, 21 W. Eppley St., Carlisle, PA (US) 17013

( * ) Notice: Subject to any disclaimer, the term of this patent is extended or adjusted under 35 U.S.C. 154(b) by 280 days.

(21) Appl. No.: 10/946,651

(22) Filed: Sep. 21, 2004

(65) Prior Publication Data

US 2005/0172525 A1 Aug. 11, 2005

Related U.S. Application Data

(60) Provisional application No. 60/543,167, filed on Feb. 10, 2004.

(51) Int. Cl.
*E02F 3/96* (2006.01)
*E02F 3/76* (2006.01)

(52) U.S. Cl. ..... 37/407; 37/408; 37/449

(58) Field of Classification Search ..... 37/449, 37/454, 403, 407, 408, 405, 26
See application file for complete search history.

(56) References Cited

U.S. PATENT DOCUMENTS 3,059,357 A * 10/1962 Irish ..... 37/449
3,775,877 A * 12/1973 Gove, Sr. ..... 37/233
4,457,380 A * 7/1984 Curry ..... 172/701.3
4,709,492 A * 12/1987 Watson ..... 37/232
5,515,625 A * 5/1996 Keigley ..... 37/405
5,715,613 A * 2/1998 Ebert ..... 37/266
D406,153 S * 2/1999 Holzer et al. ..... D15/32
6,360,458 B2 * 3/2002 Dolister ..... 37/195
6,363,633 B1 * 4/2002 Holzer et al. ..... 37/446
6,962,012 B1 * 11/2005 Grimmett et al. ..... 37/381
2001/0045030 A1 * 11/2001 Dolister ..... 37/403

* cited by examiner

*Primary Examiner*—Thomas A Beach
(74) *Attorney, Agent, or Firm*—McNees Wallace & Nurick LLC

(57) ABSTRACT

A landscaping tool for attachment to a bucket of a landscaping vehicle, the tool generally comprising an elongate plate having two opposite longitudinal working edges and a plurality of integrally formed teeth protruding from each working edge. The elongate plate has a plurality of mounting holes extending therethrough for mounting the tool to the bucket attachment of a loader. The plurality of holes can be arranged in sets to allow mounting of the tool in various orientations and configurations to provide differing edge orientations for different landscaping tasks, and to allow a single tool to be used with a variety of different bucket attachments. Methods of converting a bucket into a rake and scarifying attachment is also provided, the methods increasing the versatility of the tool and thereby eliminating the need to purchase several tools to accomplish a wide variety of landscaping tasks.

9 Claims, 7 Drawing Sheets

LANDSCAPING APPARATUS AND METHOD

CROSS REFERENCE TO RELATED APPLICATIONS

This application claims priority to U.S. Provisional Patent Application No. 60/543,167 filed on Feb. 10, 2004, which application is hereby incorporated by reference.

BACKGROUND OF THE INVENTION

This invention relates to landscaping apparatus and methods, and more particularly, to apparatus and methods for grading, raking, and leveling of soil using skidloaders, tractors, and other powered landscaping vehicles and equipment.

Landscaping is an essential part of virtually any construction project, and is particularly critical to the final stages of construction. For example, grading and leveling of soil is necessary to ensure proper rainfall drainage, scarifying is necessary to remove large rocks and debris, and raking is required to smooth soil and remove smaller rocks and debris prior to installation of driveways and walkways, as well as to cultivate prior to lawn seeding. The use of highly maneuverable skid loaders has reduced the amount of manual labor required for the above-described landscaping tasks. Additionally, skid loaders include hydraulic lift arms and pivoting attachment assemblies (typically having a bucket attached) that can be operated while maneuvering the skid loader. Such skid loaders are thus well-suited for precision landscaping operations, and are particularly well-suited for work in confined areas.

However, the lack of multi-purpose attachments for skid loaders and other landscaping equipment has limited full utilization of the vehicles. For example, several rake attachments are known, such as those described in U.S. Pat. No. 6,360,458 to Dolister and U.S. Pat. No. 5,515,625 to Keigley. However, the use of these known rakes is limited by their structure and features. For example, the attachment disclosed in Dolister can only be used as a rake when the skid loader bucket is elevated and tipped forwardly. However, with the bucket raised and tipped, driver visibility of the soil being worked is compromised. Additionally, reduced forward clearance results from the forwardly tipped bucket, preventing the use of the device in a zero-tolerance environment such as in very close proximity to a building foundation or poured concrete sidewalk. In addition, the one-dimensional rake invention described in Dolister includes just one working surface that can be mounted and used in a single configuration.

Similarly, the rake and scarifying attachment disclosed by Keigley is appropriate for a very limited number of applications as a result of its features and configuration. For example, while the apparatus disclosed in Keigley provides two sets of separate working surfaces, the configuration and arrangement of the rake and scarifying teeth prevent use of either in a zero-clearance environment. Additionally, installation and use of the Keigley apparatus is cumbersome. For example, installation of the Keigley apparatus first requires removal of the bucket of the vehicle, which removal is time-consuming, and potentially dangerous. Removal of the bucket also severely compromises the utility of the skid loader. For example, no large rocks, other debris, or soil loads can be transported when the Keigley attachment is installed on the skid loader.

Thus, there is a continuing need for a single landscaping tool that is suitable for attachment to a wide variety of landscaping vehicles such as all-terrain skidloaders, tractor loaders, backhoes, tractors, bulldozers, and other landscaping vehicles.

There is further a continuing need for a landscaping tool that can be selectively mounted on a material handling vehicle in multiple orientations or configurations to permit use in a wide variety of landscaping functions such as of grading, filling, leveling, scarifying, and vegetation removal. There is a further need for a tool that can be easily transported and easily installed to provide more than one working surface.

Furthermore, there is a need for an attachment that can be installed and used without removing or compromising the utility of the bucket of the landscaping vehicle. Lastly, there is a continuing need for an attachment that provides zero-tolerance raking and landscaping tasks without compromising front clearance or operator visibility.

SUMMARY OF THE INVENTION

In one embodiment, the invention is an apparatus for attachment to landscaping equipment, the apparatus comprised of: an elongate plate having a first longitudinal edge, a second opposite longitudinal edge, and a middle plate portion disposed between the first longitudinal edge and the second opposite longitudinal edge; wherein the first longitudinal edge includes a plurality of teeth, each tooth separated from the adjacent tooth by a trough; the second longitudinal edge includes a plurality of teeth, each tooth separated from the adjacent tooth by a trough; and the middle portion includes a plurality of apertures for mounting the tool to the bucket attachment of a landscaping vehicle, at least two of the apertures corresponding to mounting apertures provided in the bottom lip of the bucket attachment. In a first embodiment, the first longitudinal edge and second opposite longitudinal edge are coplanar. In another embodiment, the first longitudinal edge and second opposite longitudinal edge are offset at a preselected angle.

In another embodiment, the invention provides methods of manufacturing a landscaping tool for attachment to a landscaping vehicle. In one embodiment, the method is comprised of the steps of providing a unitary piece of elongate stock material, and cutting the unitary piece of stock material to form a tool having a first longitudinal edge and an opposite longitudinal edge joined by a middle plate portion, each edge having a plurality of teeth protruding from the edge and divided by troughs, the plurality of teeth provided substantially coplanar with their respective edge. Preferably, the methods are further comprised of the step of offsetting the first longitudinal edge and second opposite longitudinal edge at a preseletected angle.

A method is also provided for landscaping in a zero-tolerance mode, the method comprised of: providing a landscaping tool comprised of an elongate plate having a first longitudinal edge, a second opposite longitudinal edge, and a middle plate portion disposed between the first longitudinal edge and the second opposite longitudinal edge, wherein the first longitudinal edge includes a plurality of teeth, each tooth separated from the adjacent tooth by a trough, and wherein the second longitudinal edge includes a plurality of teeth, each tooth separated from the adjacent tooth by a trough; and wherein the middle portion includes a plurality of apertures for mounting the tool to the bucket attachment of a landscaping vehicle, at least two of the apertures corresponding to mounting apertures provided in the bottom lip of the bucket attachment; and wherein the first longitudinal edge and second opposite longitudinal edge are offset at a preselected angle. The method further includes mounting the landscaping tool to the bottom lip of a bucket attachment of a landscaping vehicle so that the teeth of one longitudinal edge protrude downward and substantially perpendicular from bottom lip of the bucket attachment and to that the teeth of the opposite longitudinal edge protrude substantially parallel to the bottom lip and towards the rear wall of the bucket; and operating the landscaping vehicle so that the downwardly projecting teeth contact soil at a location substantially adjacent the front lip of the bucket; and moving the landscaping vehicle while maintaining the bucket in a substantially horizontal position so as to manipulate the soil using the downwardly projecting teeth.

Accordingly, an object of this invention is to provide for a novel and unique multi-purpose attachment for use with a landscaping vehicle.

Another object is to provide a multi-purpose attachment for a landscaping vehicle, the attachment suitable for pushing and pulling soil during grading, filling, leveling, scarifying and vegetation removal.

Another object is to provide for a low maintenance multi-purpose attachment for a landscaping vehicle, the attachment having a multi-purpose configuration with a plurality of working surfaces that is configured to provide a clear line of operator vision to the ground being worked.

Other objects will become apparent upon a reading of the following description.

While the invention will be described in connection with certain preferred embodiments, there is no intent to limit it to those embodiments. To the contrary, the intent is to cover all alternatives, modifications and equivalents as included within the spirit and scope of the invention as defined by the appended claims.

DETAILED DESCRIPTION OF THE DRAWINGS

The apparatus of the present invention is comprised of a supporting framework that can be easily and removeably mounted onto a variety of landscaping vehicles and other lifting equipment such as, but not limited to, backhoes, tractors, skid loaders, all-terrain vehicles, trucks, and the like. By way of example, FIGS. 5-13 illustrate views of a first embodiment of the apparatus of the present invention mounted on an all-terrain skid loader in various positions, showing the assembly attached to the bucket of the skid loader. While an all-terrain vehicle such as a skid loader or a tractor is preferred, any motorized vehicle having a lift apparatus and a mounting surface such as a bucket or an attachment mounting plate or the like can be used to support, maneuver, and operate the apparatus of the preset invention.

Figure 1:
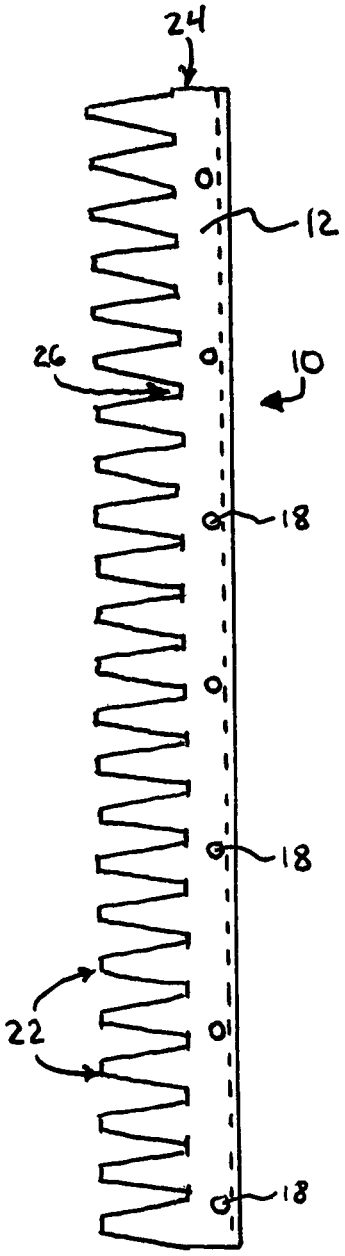
FIG. 1 is a top view of the multi-purpose attachment according to the present invention.
Figure 3:
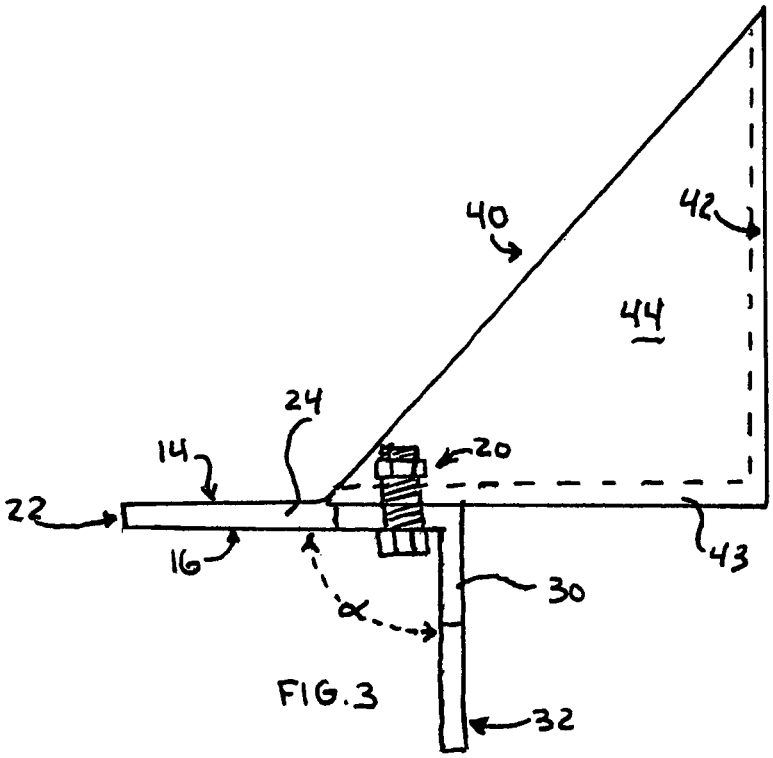
FIG. 3 is a side perspective view, partially in section, of the multi-purpose attachment of FIG. 1 installed on the bucket of a landscaping vehicle according to the present invention.
Figure 4:
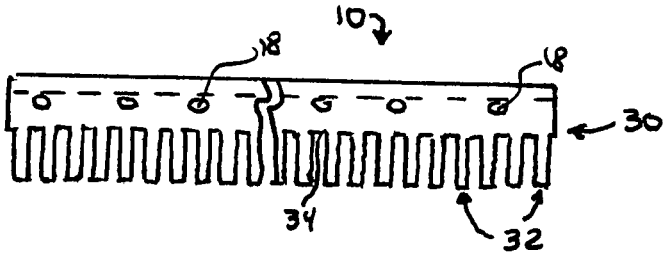
FIG. 4 is a rear view of the multi-purpose tool attachment of FIG. 1.
Figure 1A:
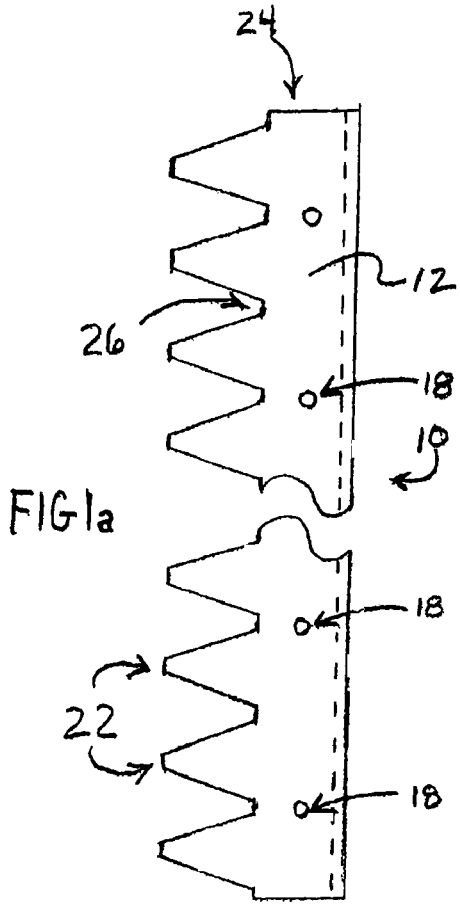
FIG. 1*a* is a top view of the multi-purpose attachment according to a second embodiment of the present invention formed by bending a unitary plate.
Figure 2A:
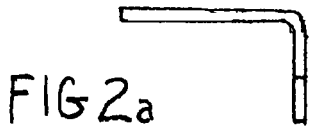
FIG. 2*a* is a side view of the multi-purpose attachment of FIG. 1*a* according to the present invention.
Figure 3A:
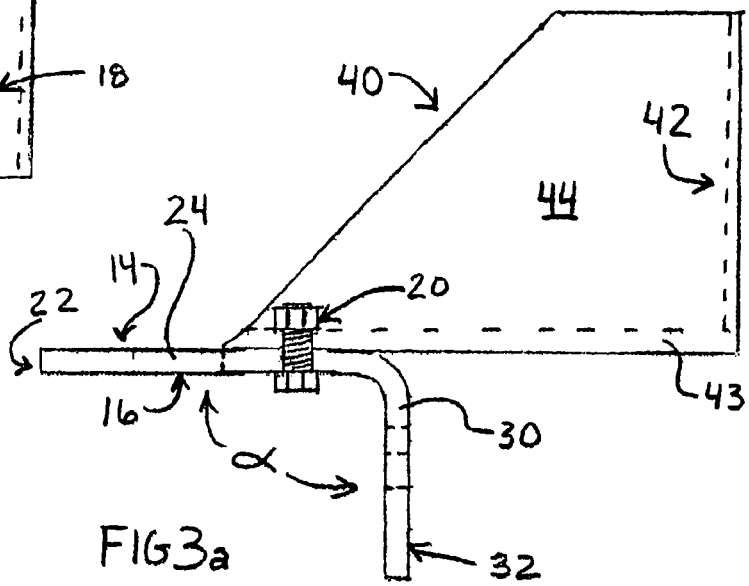
FIG. 3*a* is a side perspective view, partially in section, of the multi-purpose attachment of FIG. 1*a* installed on the bucket of a landscaping vehicle according to the present invention.
Figure 4A:
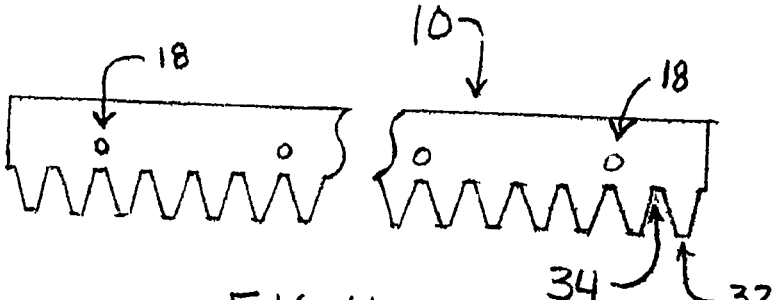
FIG. 4*a* is a rear view of the multi-purpose tool attachment of FIG. 1*a*.
Figure 5:
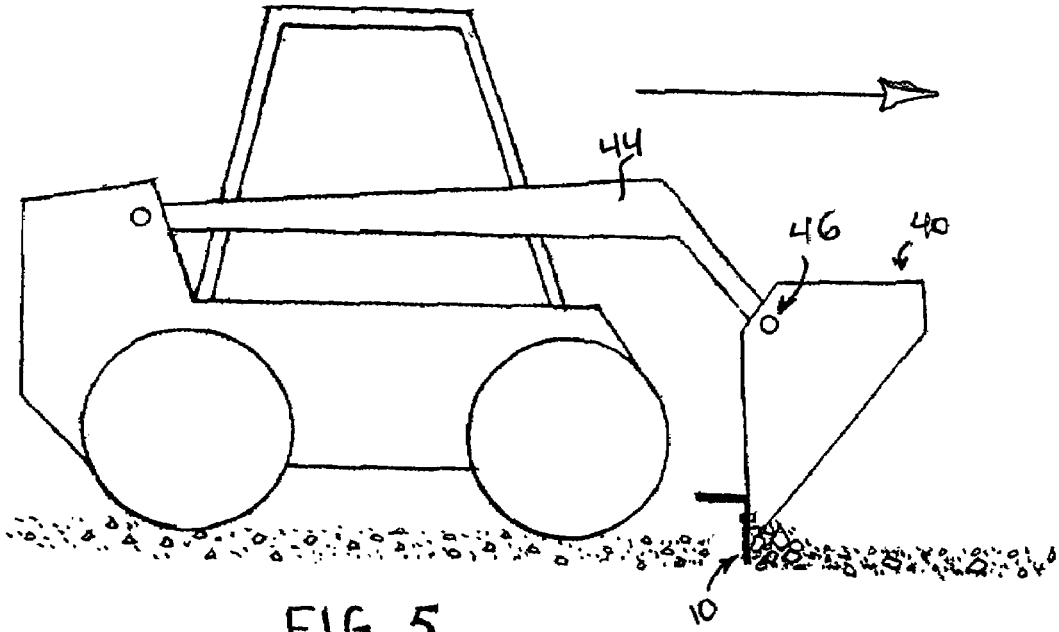
FIG. 5 is a side perspective view of the multi-purpose attachment of FIG. 1 installed on the bucket of a landscaping vehicle, with the bucket forwardly tipped according to methods of the present invention.
Figure 6:
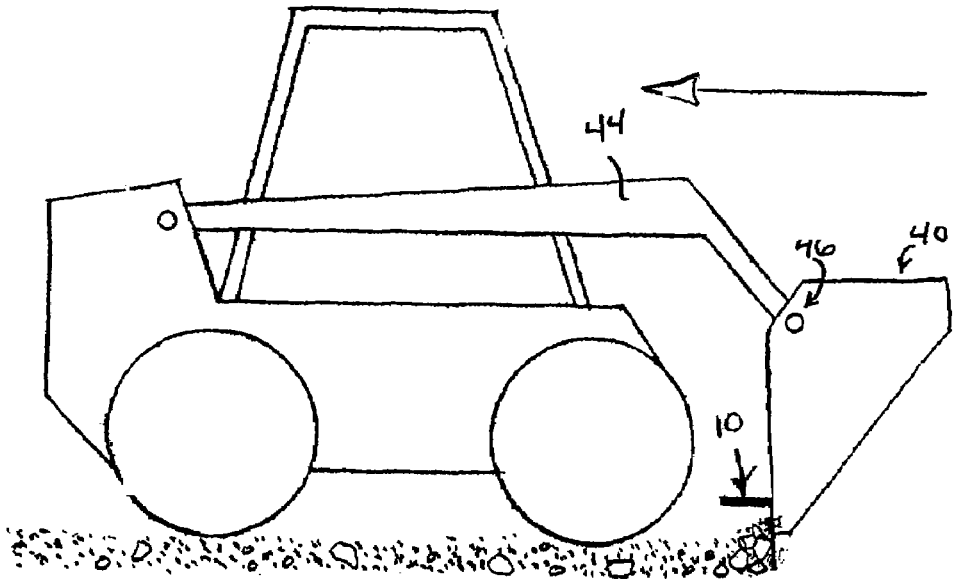
FIG. 6 is a side perspective view of the multi-purpose attachment of FIG. 1 installed on the bucket of a landscaping vehicle, with the bucket forwardly tipped according to methods of the present invention.

Referring now to the drawings, FIG. 1 shows a preferred embodiment of the present invention. The tool 10 generally comprises an elongate plate 12. As shown in FIG. 3, the elongate plate 12 has a top surface 14, a bottom surface 16, and a plurality of mounting holes 18 extending through the top surface 14 to the bottom surface 16 of the plate 12. The holes 18 are shown having a circular shape, however, square, hexagonal, or any other suitable shape or size of holes 18 may be employed in conjunction with the present invention. The mounting holes 18 preferably include a countersink portion adjacent the top surface 14, bottom surface 16, or both, to allow the fasteners 20, such as bolts with nuts, to be recessed from the top surface 14 and/or bottom surface 16. Countersinks allow the fasteners 20 to avoid sharp impacts that can damage the fasteners, and can also help to keep the fastener components in a fixed tightened position. For example, where carriage bolts having a square head portion adjacent the threads, the countersink can be square or rectangular to engage the square head portion. Similarly, where hexagonal nuts are used as fasteners 20, the countersink can be hexagonal in shape to securely engage the nut.

The mounting holes 18 are spaced along the length of the plate 12. The length of the plate 12 corresponds generally with the width of the bucket of the landscaping equipment, and in the preferred embodiment the length of the plate 12 is about six feet. The width and thickness of the plate 12 can be varied to allow different lengths and types of rake teeth and scarifying teeth while providing rigidity and durability characteristics to the tool 10. In one embodiment, the plate 12 has a width between approximately eight to ten inches, and a thickness of about ½ inch to provide sufficient strength for enduring continuous raking engagement with a soil surface.

A plurality of teeth 22 project along a first longitudinal edge 24 of the plate 10. The teeth 22 may have squared or sharpened ends, but preferably have radiused points. Between adjacent teeth 22, are provided troughs 26 which connect the adjacent teeth 12. In the preferred embodiment, the teeth form a scarifying rake having has approximately four to five teeth per foot. The teeth generally project from the plate edge 24 approximately five to six inches, and have the same thickness as the plate 12. While the aforementioned dimensional ranges for the scarifying rake, particularly the length, teeth per foot and tooth length, are the preferred ranges for a scarifying rake for a skid steer loader, the present invention can be employed with dimensions outside of these preferred ranges. For example, the teeth 22 may be of different lengths, and may be interspersed along the length of the edge 24 in a preselected pattern to provide a uniform pattern of alternating, ascending or descending lengths and/or widths, much as known scarifying tools and rakes have varying configurations.

The tool 10 further includes a second longitudinal edge 30. In one embodiment, the second longitudinal edge 30 is provided on the end of the plate 10 opposite the first edge 24. The second edge 30 includes a plurality of teeth 32 having terminal points that can be squared, radiused or sharpened, but that preferably have squared terminal points. Between adjacent teeth 32, are provided troughs 34 which connect the adjacent teeth 32. In a preferred embodiment, the second edge 30 has teeth 32 that form a rake with teeth having substantially uniform length, width, and spacing as compared to the teeth 22 of the first edge 24. The teeth 32 preferably project from the plate 30 a sufficient length so as to permit use in raking and similar landscaping tasks. Preferably, the teeth 32 extend at least one inch, and have approximately the same thickness as the plate 12.

While the aforementioned dimensional ranges for the tool 10, particularly the length, teeth per foot and tooth length, are the preferred ranges for a rake and scarifying attachment for a skid steer loader, the present invention can be employed with dimensions outside of these preferred ranges. For example, the teeth 22, 32 may be of different lengths, and may be interspersed along the length of the respective edges 24, 30 in a preselected pattern to provide a uniform pattern of alternating, ascending or descending lengths and/or widths, much as known scarifying tools and rakes have varying teeth configurations.

In the preferred embodiment, the plate 12 is a single plate cut from a unitary plate of solid steel material in a single plasma cutting operation. This method of manufacture provides suitable strength and durability of the individual teeth 22, 32 and the tool 10 as a whole. In this embodiment, because the tool 10 is a unitary plate member which can be attached by conventional fasteners, the tool 10 is very cost efficient and inexpensive relative to other prior art attempts. Additionally, in this embodiment, multiple tools 10 may be plasma cut from steel plate stock, thereby greatly reducing scrap material. Likewise, a first set of mounting holes 18 is provided in the plate 12 at a predetermined location, and the holes 18 can also be plasma cut, or may be drilled or otherwise provided.

Figure 2:
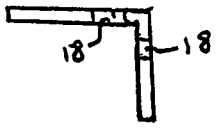
FIG. 2 is a side view of the multi-purpose attachment of FIG. 1 according to the present invention.

As shown in FIG. 3, in a preferred embodiment, the edges 24, 30 are not coplanar, rather they are offset. For example, the edges may be offset by the angle $\alpha$ from approximately between 1 degree to approximately 179 degrees. The offset can be created by either bending the plate 12, or by joining two plates together at a predetermined angle, such as by welding, tabbing, overlapping, or other means of joining two plates to form a substantially unitary structure. In the preferred embodiment of FIGS. 2-3, the tool 10 is provided having the first edge 24 offset from the second edge 30 by approximately 90 degrees. This preferred embodiment enables the maximum number of mounting orientations to allow use of either, or both, edges 24,30 for landscaping tasks. As shown in FIG. 3, the tool 10 can be mounted under the bottom lip of the bucket 40 with the first edge 24 protruding outwardly and substantially parallel with the bottom lip of the bucket 40, and the second edge 30 protruding downwardly and substantially perpendicular to the bottom lip of the bucket 40. As shown in FIGS. 5-12, this configuration allows the operator to selectively use the teeth 22, 32 on either edge 24, 30 by adjusting the bucket position, without the need to remove or reconfigure the tool 10.

Additionally, if the landscaping task requires the use of the first edge 24 in the downward protruding position and the use of the second edge 30 in a forwardly protruding position, the tool 10 can be removed, axially rotated and turned to the desired position, and then re-mounted under the lip of the bucket 40 using the mounting holes 18 provided on the second edge 30.

Figure 13:
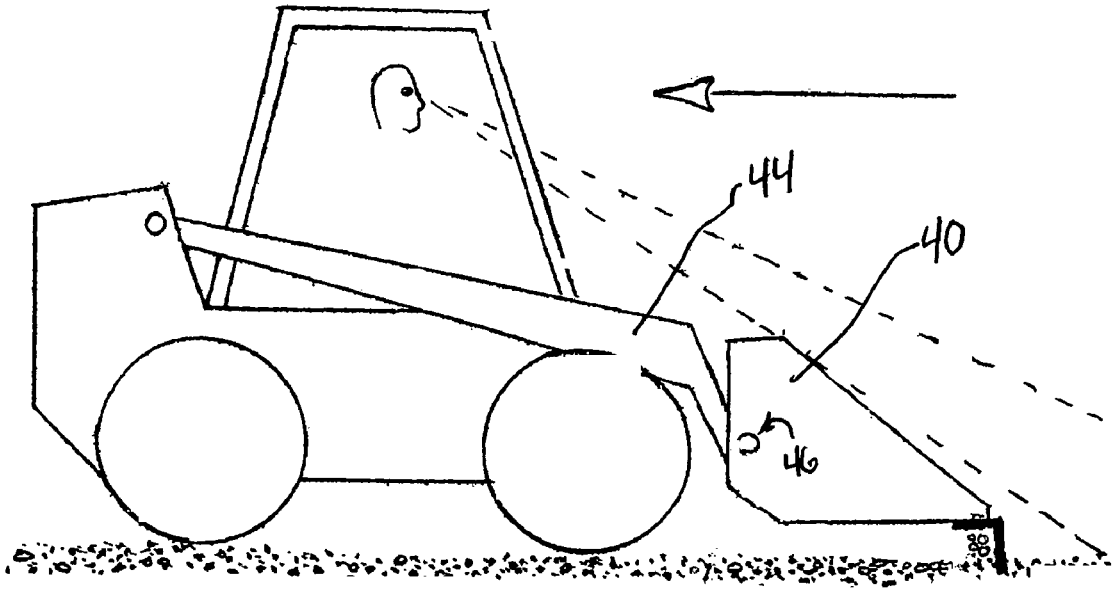
FIG. 13 is a side perspective view of the multi-purpose attachment of FIG. 1 installed on the bucket of a landscaping vehicle, with the tool mounted to permit zero-tolerance raking according to methods of the present invention.

Lastly, as shown in FIG. 13, the tool 10 can also be mounted so as to provide a single exposed edge 24,30. This mounting position is particularly suited for in zero-tolerance applications such as raking in very close proximity to a building foundation, sidewalk, or other structure or obstacle. The single-edge exposure mounting can be accomplished, for example, by mounting the tool 10 so that the first working edge 24 is protruding substantially downwardly from the bottom lip of the bucket 40, with the opposite second edge 30 protruding inwardly towards the rear wall 42 of the bucket 40. In another example, exposure of the second edge 30 as a zero-tolerance working surface can be accomplished by mounting the tool 10 so that the second edge 30 is protruding substantially downwardly from the bottom lip of the bucket 40, with the opposite first edge 24 protruding inwardly towards the rear wall 42 of the bucket 40. The flexible mounting methods are facilitated by providing mounting holes 18 at preselected locations along the plate, and particularly providing a set of multiple holes along each edge 24,30 so that at least one set of mounting holes 18 is juxtaposed adjacent the bottom lip of the bucket 40 to permit the passing of at least one fastener 20 through each mounting hole 18 and through a corresponding mounting hole provided in the bottom lip of the bucket 40.

Figure 7:
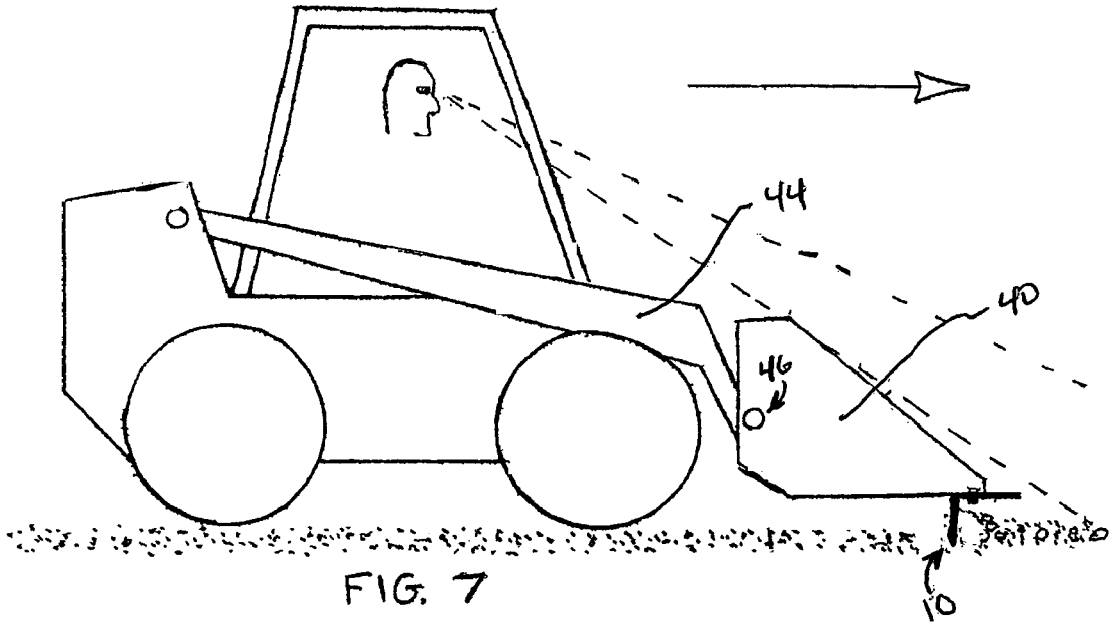
FIG. 7 is a side perspective view of the multi-purpose attachment of FIG. 1 installed on the bucket of a landscaping vehicle, with the bucket in its upright position according to methods of the present invention.
Figure 8:
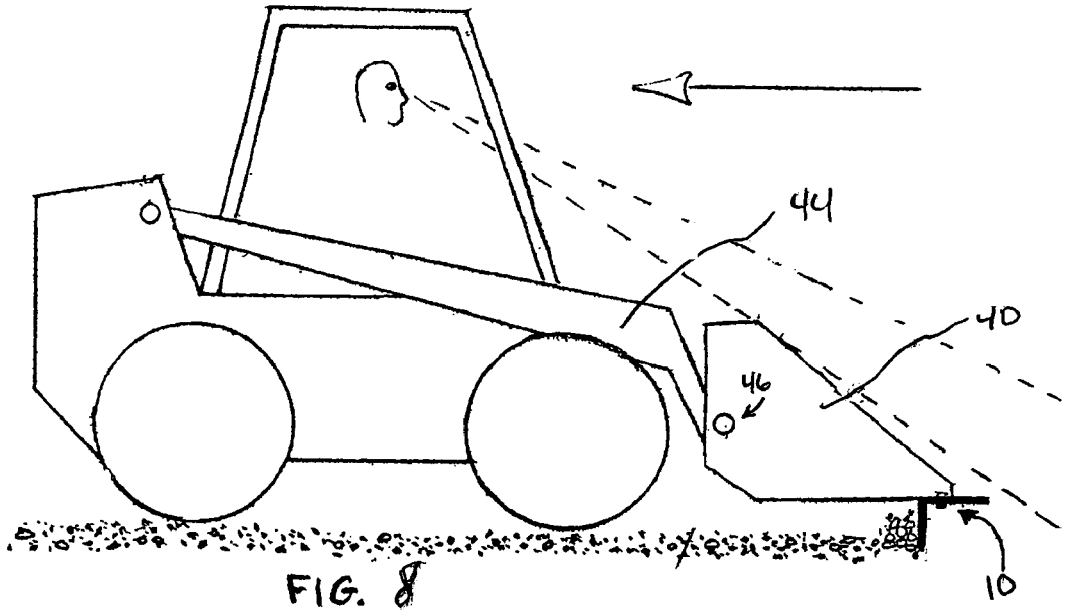
FIG. 8 is a side perspective view of the multi-purpose attachment of FIG. 1 installed on the bucket of a landscaping vehicle, with the bucket in its upright position according to methods of the present invention.
Figure 9:
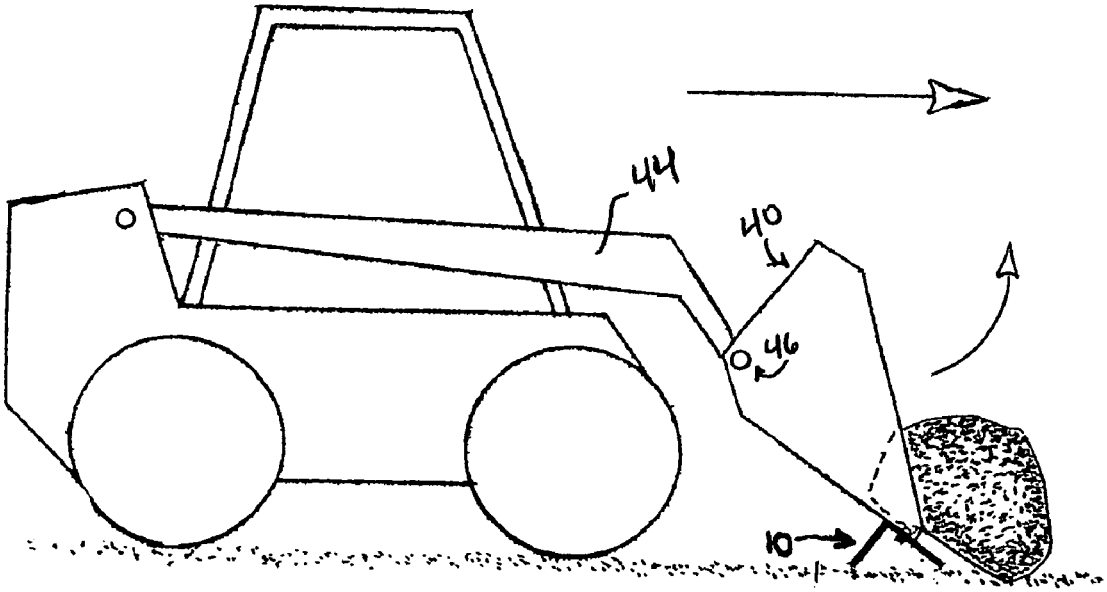
FIG. 9 is a side perspective view of the multi-purpose attachment of FIG. 1 installed on the bucket of a landscaping vehicle, with the bucket engaging in lifting a large rock according to methods of the present invention.
Figure 10:
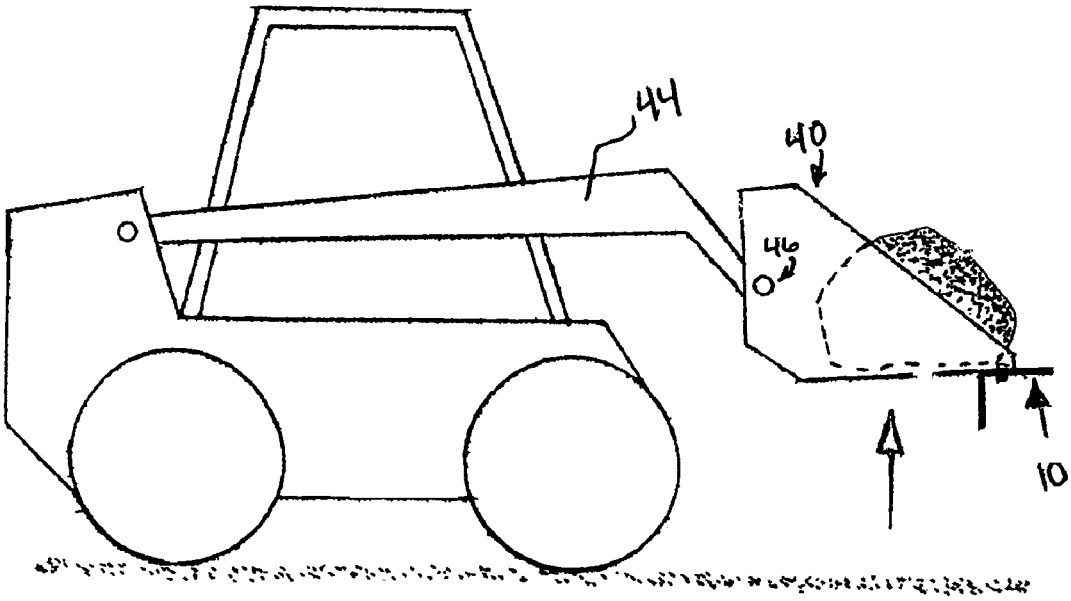
FIG. 10 is a side perspective view of the multi-purpose attachment of FIG. 1 installed on the bucket of a landscaping vehicle, with the bucket engaging in lifting a large rock according to methods of the present invention.
Figure 11:
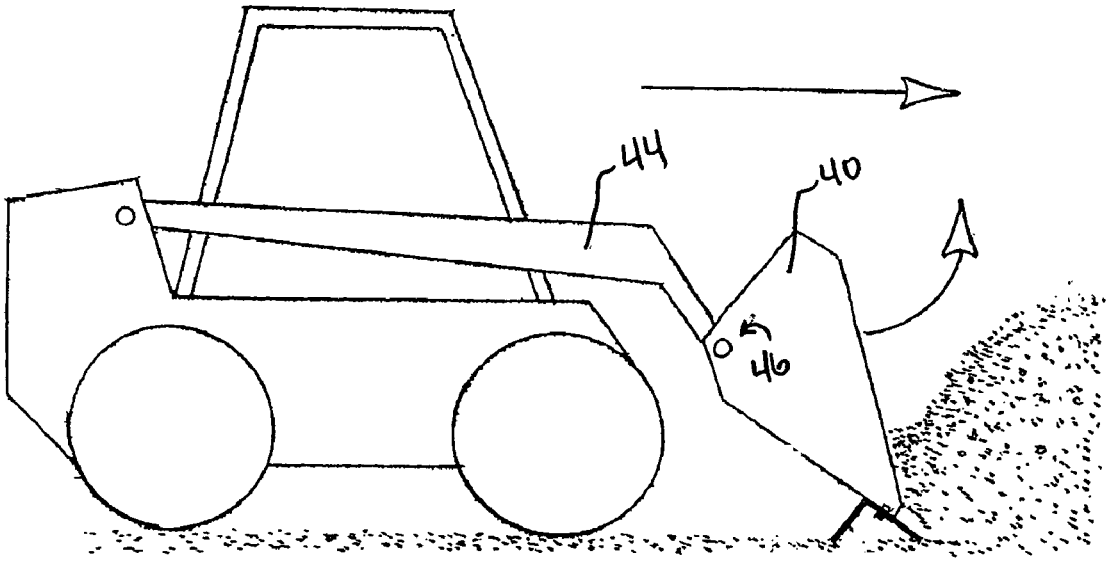
FIG. 11 is a side perspective view of the multi-purpose attachment of FIG. 1 installed on the bucket of a landscaping vehicle, with the bucket engaging in scooping loose soil according to methods of the present invention.
Figure 12:
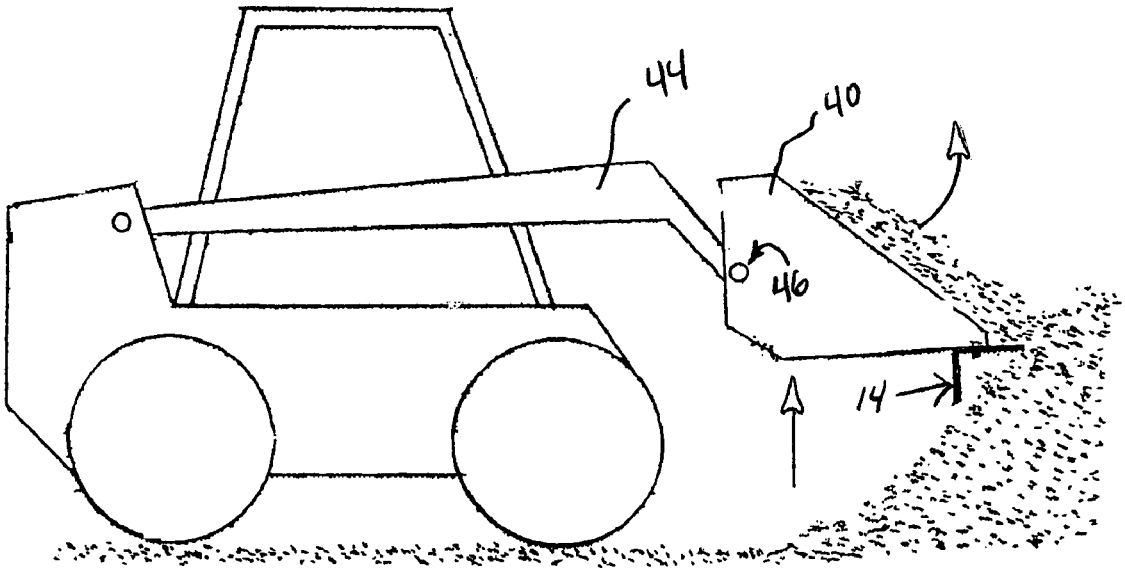
FIG. 12 is a side perspective view of the multi-purpose attachment of FIG. 1 installed on the bucket of a landscaping vehicle, with the bucket engaging in scooping loose soil according to methods of the present invention.

A typical bucket attachment comprises a bucket 40 having a rear wall 42, a bottom wall 43 and sidewalls 45. When the loader arms 44 are in their down position, as shown in FIGS. 3, 7 and 8, the rear wall 42 is substantially vertical. Optionally, a top lip may be fixed to the upper edge of rear wall 42. Although the rear wall 42 is shown as being substantially flat, the rear wall 42 can be curved to form a scoop. In any event, the rear wall 42 extends downwardly towards bottom wall 43 which is generally perpendicularly disposed to the back wall 42, and is generally horizontal when the loading arms 44 are in the downward position. Rear wall 42 can be directly connected to bottom wall 43, or the walls 42, 43 can be interconnected by in intermediate wall (not shown). Side walls 45 are generally parallel to one another, and are shaped such that their perimeter corresponds with and is fixed to the side edges of rear wall 42, and bottom wall 43, thereby enclosing the structure and forming the bucket 40. The bottom wall 43 preferably extends beyond the sidewalls 45 to form a lip 47.

The bottom wall 43 has a bottom surface that extends generally parallel with the bottom wall 43. The thickness of bottom wall 43 may narrow slightly at the lip 47 to form a pointed edge, or may remain constant to form a relatively flat edge. The lip 47 contains a plurality of apertures 48 extending through the lip 47. Many bucket attachments come directly from the manufacturer with these apertures formed in the front lip 47. The apertures 48 are spaced apart by specific dimensions, those dimensions differing only among manufacturers and bucket sizes. Different manufacturers often have different spacing between the apertures, and each manufacturer may vary their own spacing of the apertures along their range of bucket sizes. The widths of different buckets may also vary, and the tool 10 of the present invention can have lengths to correspond with the varying widths of buckets from different commercial manufacturers.

In accordance with an aspect of the present invention, the plate 12 of the tool 10 has universal mounting holes 18 to facilitate mounting of the tool 10 to the buckets of different commercial manufacturers, as shown in FIG. 3. The number of holes 18 in the tool 10 generally outnumbers the number of apertures 48 in the front lip 47 of the bucket 40. The spacing of the holes 18 is designed so that different combinations of holes 18 may be used to create sets that correspond with a variety of different bucket attachments 40. In this way, a single tool 10 can be used for a wide variety of different bucket attachments 40 produced by various manufacturers. For example, in a preferred embodiment illustrated in FIG. 1, the tool 10 contains two sets of seven holes 18 extending through the plate 10, one set on each side of the midline of the plate 12. Depending upon the desired mounting position and configuration, just one set of mounting holes will be juxtaposed adjacent the holes 48 in the bucket, permitting the passing of fasteners 20 through the holes 18, 48 to secure the tool to the lower wall 43 or lip 47 of the bucket 40. When affixing the tool 10 to a bucket attachment 40, usually fewer than all holes 18 in a set are used, depending upon whether the holes 18,48 line up. However, due to the rigid construction of the tool 10, use of less than all holes 18 in a set will not adversely affect performance.

FIGS. 5-13 show a preferred embodiment of the tool 10 installed and used on a skid steer loader having a bucket attachment 40. However, the tool 10 is designed to be removeably mounted to the bucket 40 of virtually any landscaping vehicle. The landscaping vehicle of FIGS. 5-13 includes loader arms 44 and a pivot assembly 46, the pivot assembly 46 connected to a mounting structure 48 for attaching a bucket 40 or other landscaping attachment. The end of the loader arms 44 opposite the pivot assembly 46 are mounted to the vehicle to form a lift structure that can be poweredly operated, such as by a hydraulic system of the vehicle. The loader arms 44 move upwardly and downwardly, operating to raise and lower the bucket 40 or other attachment to the mounting structure of the vehicle. The pivot assembly 46 extends and retracts, forcing the mounting structure 49, and thus the bucket attachment 40, to rotate about its point of connection with the loader arm 44. The operability of loader arms 44 and pivot assembly 46 permit the manipulation of mounting structure 49, and thus any attachment 40 fixed to mounting structure 49, in a wide variety of movements and configurations.

Loader arms 44 extend down in front of the loader and are attached to mounting structure 49. Mounting structure 49 is coupled to the back wall 42 of bucket attachment 40, such as by brackets. The front lip 47 contains apertures 48 that are spaced in a specific fashion. The holes 18 of the tool 10 are spaced to correspond with the particular bucket attachment 40, based on the manufacturer and bucket size. As best seen in FIG. 3, a fastener 20, such as a plurality of washers, nuts and bolts are used to attach the tool to the bucket attachment 40. As previously described, the holes 18 in the plate 12 of the tool 10 can also include a countersink portion.

The method of converting a bucket 20 into a rake and scarifying attachment implement includes the steps of providing the proper tool 10 based on the manufacture and size of the bucket attachment 40, aligning the tool 10 and bucket attachment 40 such that the teeth 22 project from the front of the bucket 40 and such that a select number or all of the holes 18 in the tool 10 are in alignment with corresponding apertures 48 in the front lip 47 or other portion of the bottom wall 43, and securing the tool 10 to the front lip 47 of the bucket attachment 40. In the preferred embodiment, this last step is accomplished by placing one or more fasteners 20, such as bolts and nuts, cotter pins, and the like, through the apertures 48 and holes 18 of the front lip 47 and plate 12. In this embodiment, nuts are affixed to the distal end of the bolts, thereby securing the tool 10 to the front lip 27 of the bucket 40.

Similarly, the rake and scarifying attachment 10 may be removed from the bucket attachment 40 by removing the fastener(s) 20. Additionally, although the apparatus has been described in a few preferred embodiments, a first horizontal embodiment, and a second vertical embodiment, the apparatus can be configured to allow mounting in either orientation. For example, as further described herein, the tool 10 plate 12 can include a plurality of mounting apertures 18 or set of apertures 18, at least one set of mounting apertures 18 configured for vertically orienting the tool, and at least one additional set of mounting apertures 18 configured for horizontally mounting the tool 10. Once removed, the rake and scarifying attachment 10 may be secured to a second bucket attachment using the methods described herein. The size and scale of the apparatus and its components are contemplated within a wide range in order to meet the needs of the landscaping industry. For example, the apparatus may be provided with varying widths and having various sizes and arrangements of teeth.

The present invention further provides methods of manufacturing a landscaping tool that is inexpensive yet easy to manufacture. In one method of manufacture, the tool is formed from a single plate of material, the unitary plate providing excellent strength and durability. In a preferred embodiment, the methods are comprised of the steps of: providing a unitary piece of elongate stock material and cutting the unitary piece of stock material to form a tool having a first longitudinal edge and an opposite longitudinal edge joined by a middle plate portion, each edge having a plurality of teeth protruding from the edge and divided by troughs, the plurality of teeth provided substantially coplanar with their respective edge. The method can be further comprised of the step of offsetting the first longitudinal edge and second opposite longitudinal edge. Preferably, the step of offsetting the first longitudinal edge and second opposite longitudinal edge includes bending the middle portion to produce a preselected offset angle.

Alternatively, the method comprised of the steps of: providing a unitary piece of elongate stock material; cutting the unitary piece of stock material to form a substantially flat first portion of a tool, the substantially flat first portion having a first longitudinal edge and an opposite longitudinal edge joined by a middle plate portion, the first longitudinal edge having a plurality of teeth protruding from the edge and divided by troughs, the plurality of teeth provided substantially coplanar with their respective edge; providing a second unitary piece of elongate stock material; cutting the second unitary piece of elongate stock material to form a substantially flat second portion of a tool, the substantially flat second portion having a first longitudinal edge and an opposite longitudinal edge joined by a middle plate portion, the first longitudinal edge having a plurality of teeth protruding from the edge and divided by troughs, the plurality of teeth provided substantially coplanar with their respective edge; and joining the opposite longitudinal edge of the first portion of the tool to the opposite longitudinal edge of the second portion of the tool to form a landscaping tool having two working opposed longitudinal edges offset at a preselected angle. Preferably, the step of joining includes welding, although the step of joining can alternatively include attaching each tool portion to at least one bracket to interconnect the tool portions at a preselected angle.

Additionally, the inventors contemplate use of the apparatus to provide new and novel methods of landscaping. Aside from the novelty of using the disclosed apparatus having a reversible configuration, the methods contemplated by the inventors provide for zero-tolerance raking by orienting and mounting the apparatus in unique configurations. In a preferred embodiment as illustrated in FIG. 13, method of zero-tolerance raking include providing a landscaping tool comprised of an elongate plate having a first longitudinal edge, a second opposite longitudinal edge, and a middle plate portion disposed between the first longitudinal edge and the second opposite longitudinal edge; wherein the first longitudinal edge includes a plurality of teeth, each tooth separated from the adjacent tooth by a trough, wherein the second longitudinal edge includes a plurality of teeth, each tooth separated from the adjacent tooth by a trough, and wherein the middle portion includes a plurality of apertures for mounting the tool to the bucket attachment of a landscaping vehicle, at least two of the apertures corresponding to mounting apertures provided in the bottom lip of the bucket attachment, and wherein the first longitudinal edge and second opposite longitudinal edge are offset at a preselected angle. The method further includes the step of mounting the landscaping tool to the bottom lip of a bucket attachment of a landscaping vehicle so that the teeth of one longitudinal edge protrude downward and substantially perpendicular from bottom lip of the bucket attachment and to that the teeth of the opposite longitudinal edge protrude substantially parallel to the bottom lip and towards the rear wall of the bucket. The step further includes operating the landscaping vehicle so that the downwardly projecting teeth contact soil at a location substantially adjacent the front lip of the bucket, and moving the landscaping vehicle while maintaining the bucket in a substantially horizontal position so as to manipulate the soil using the downwardly projecting teeth.

While the invention is described in terms of raking and scarifying, the apparatus and methods are equally applicable to removal of brush and other landscaping tasks wherein scarifying teeth and rakes can be utilized. Alternatively, or additionally, where differing teeth configurations are provided on each working edge of the tool, the operator can selectively engage either working surface to change tasks without removing or repositioning the tool, such as scarifying by tipping the bucket forward to engage an edge having scarifying teeth, then raking by tipping the bucket back to its horizontal position to engage downwardly pointing rake teeth on a second edge of the tool.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for attachment to landscaping equipment, the apparatus comprised of:

A substantially unitary elongate plate having a first longitudinal edge, a second opposite longitudinal edge that is not coplanar with the first longitudinal edge, and a middle plate portion disposed between the first longitudinal edge and the second opposite longitudinal edge; wherein the first longitudinal edge includes a plurality of teeth, each tooth separated from at least one adjacent tooth by a trough;

the second longitudinal edge includes a plurality of teeth, each tooth separated from at least one adjacent tooth by a trough; and the middle portion includes a plurality of apertures for mounting the tool to the bucket attachment of a landscaping vehicle, at least two of the apertures corresponding to mounting apertures provided in the bottom lip of the bucket attachment, wherein the first longitudinal edge and second opposite longitudinal edge are both exposed for working of a soil surface provided substantially adjacent the front lip of a bucket attachment of a landscaping vehicle when the tool is mounted to the bucket attachment of the landscaping vehicle; and, wherein each tooth provided on the first longitudinal edge has a base portion adjacent the first longitudinal edge and a terminal point portion opposite the base portion, the base portion having a width that is greater than the width of the tooth at the terminal point portion, and wherein each tooth provided on the second opposite longitudinal edge has a second base portion adjacent the second longitudinal edge and a second terminal point portion opposite the second base portion, the second base portion having a width that is approximately the same as the width of the tooth at the second terminal point portion.

2. The apparatus of claim 1, wherein the first longitudinal edge and second opposite longitudinal edge are offset at a preselected angle.

3. The apparatus of claim 2, wherein the preselected angle is between about 1 degree and about 179 degrees.

4. The apparatus of claim 3, wherein the preselected angle is between about 45 degrees and about 135 degrees.

5. The apparatus of claim 4, wherein the preselected angle is between about 45 degrees and about 90 degrees.

6. The apparatus of claim 2 wherein the first longitudinal edge includes at least 1 tooth per foot.

7. The apparatus of claim 6, wherein the second longitudinal edge includes at least 4 teeth per foot.

8. The apparatus of claim 2, wherein the elongate plate is comprised of metal, the plate having a substantially uniform thickness.

9. The apparatus of claim 8, wherein the elongate plate and the plurality of teeth provided on the first longitudinal edge and second opposite longitudinal edge are cut from a unitary piece of metal stock.

* * * * *